US005533782A

United States Patent [19]

Goldman

[11] Patent Number: 5,533,782

[45] Date of Patent: Jul. 9, 1996

[54] DEVICE FOR STORING AND DISPLAYING MATERIALS ON A STADIUM ARMREST

[76] Inventor: Mark L. Goldman, 1009 Ferncliff Rd. NE., Atlanta, Ga. 30324

[21] Appl. No.: 409,018

[22] Filed: Mar. 23, 1995

[51] Int. Cl.[6] ..... A47C 7/68

[52] U.S. Cl. ..... 297/188.18; 297/188.14; 297/411.23; 297/188.01; 297/188.20; 24/67.11; 24/67.9; 24/563

[58] Field of Search ..... 297/188.14, 188.18, 297/411.23, 188.01, 188.20; 24/67.11, 67.9, 563

[56] References Cited

U.S. PATENT DOCUMENTS

| | | | |
|---|---|---|---|
| 3,675,969 | 7/1972 | Gage | 297/194 |
| 3,690,724 | 9/1972 | Douglas et al. | 297/194 |
| 4,261,479 | 4/1981 | Caserta | 220/326 |
| 4,262,962 | 4/1981 | Yust | 297/188.18 |
| 4,548,326 | 10/1985 | Danna et al. | 211/71 |
| 4,795,211 | 1/1989 | Stern et al. | 297/194 |
| 4,863,134 | 9/1989 | Young et al. | 297/188.18 |
| 4,898,115 | 2/1990 | Bowlay-Williams | 24/563 X |
| 4,908,912 | 3/1990 | Grant | 24/67.11 |
| 5,234,251 | 8/1993 | Ayotte | 297/188.14 |
| 5,302,000 | 4/1994 | Ayotte | 297/188.14 |
| 5,320,406 | 6/1994 | North | 297/188.14 |
| 5,395,085 | 3/1995 | Mann | 297/188.14 |

*Primary Examiner*—Peter M. Cuomo
*Assistant Examiner*—Stephen Vu
*Attorney, Agent, or Firm*—Deveau, Colton & Marquis

[57] ABSTRACT

A device for displaying and retaining informational literature and advertising material on the armrest of a stadium or theatre seat. The device includes a resilient flap under which the advertisements or materials are placed. The device may also include a cup-holder and display surfaces for advertisements.

6 Claims, 2 Drawing Sheets

DEVICE FOR STORING AND DISPLAYING MATERIALS ON A STADIUM ARMREST

BACKGROUND OF THE INVENTION

1. Field of the Invention

The present invention relates generally to a device for storing and displaying information and advertising materials on the armrests of stadium or theatre seats. More specifically, this invention relates to a device fabricated to closely match the contours of the existing armrests of stadium, theatre, or arena seats, the device having a resilient clip or flap for retaining advertising and informational material in a manner which permits stadium patrons to remove and inspect the materials at their leisure. The external surfaces of the device may be adapted to display further advertising materials printed, or adhered thereon. Optionally, the device may also include a beverage cup holder.

2. Description of Related Art

The popularity of spectator sports has grown in recent years leading to the construction of stadiums and arenas capable of accommodating tens of thousands of avid sports fans. In order to make the viewing experience more pleasurable for these spectators, modern sports facilities are generally provided with seating of a standard variety having upright seatbacks, armrests, and folding seat bottoms. Similar seats are also found in theatres and other like facilities.

Advertisers of various products and services have found that the large number of potential consumers present at sporting and other such cultural events provides a valuable advertising opportunity. Likewise, the facility operators have a need to provide the fans with safety information, public service announcements, notice of up-coming events, and various other information. Numerous methods have been devised to advertise or display information at these events, including signs and billboards, announcements over the public address system, sponsor logos on team uniforms, blimps, and streamers pulled behind airplanes, to name but a few. One drawback of such advertising methods, however, is that they lack the ability to address each fan on an individual basis. For example, many advertisers find it desirable to provide coupons or other advertisements which the potential consumer can remove from the stadium to use or further review at a later time. Thus it has been found that spectators at these events constitute a "captive audience" of potential consumers, to which advertisers and others wish to direct personalized advertising and informational messages.

Additionally, it has been found that it is desirable to provide stadium or theatre patrons with a "cup-holder" device designed to accommodate containers of beer, soft drinks, popcorn, and the like, which are purchased by stadium patrons. Although, some stadium seats incorporate such cup-holders into their basic design, it is known that many venues lack such amenities. Patrons using seats lacking such devices are often forced to place their refreshments on the floor of the seating area, where they are frequently kicked over and spilled.

A variety of devices have been developed to remedy this situation by retrofitting existing stadium seats with cup-holder devices. For example Gage, U.S. Pat. No. 3,675,969, Stern et al., U.S. Pat. No. 4,795,211 and Young et al., U.S. Pat. No. 4,863,134, all disclose cup-holder devices for attachment to existing theatre or stadium seats. A variation of such devices is shown by Ayotte U.S. Pat. No. 5,302,000. Similarly, a number of devices, such as those of Douglas et al., U.S. Pat. No. 3,690,724 U.S. Pat. No. 4,262,962 Yust, and Danna et al., U.S. Pat. No. 4,548,326 show trays having cup-holder means which are adapted to be mounted on existing armrests.

None of the known devices, however, makes provision for storing or displaying information and advertising materials in a manner which permits stadium patrons to remove and inspect the materials at their leisure. Stem et al. does disclose a recessed display area in the upper surface of its armrest portion, whereby advertising material may be inserted beneath a transparent plate so that it can be seen by the seat occupant. This arrangement, however, does not enable the seat occupant to remove and inspect the advertising material deposited therein. Additionally, the device of Stem et al. can display only a single advertisement at any given time, and requires significant disassembly to insert new material. Also, because the advertising material displayed by Stem, et at. is recessed into the surface of the device, the advertisement is less conspicuous and will often go unnoticed by the seat occupant. By contrast, the device of the present invention allows the advertising and informational material retained thereon to be displayed in a conspicuous manner, where it cannot be ignored by the seat occupant.

Also, because known devices typically mount to the top surface of a seat's armrest, they may interfere with attempts to install the storage and display device of the present invention. Additionally, the comfort provided stadium patrons will be increased if a unitary armrest surface is provided, which does not have seams, raised edges or fasteners projecting therefrom. Thus, it has been found desirable to provide the presently-described storage and display device with an integral cup-holder, so that a single, multi-purpose device may be installed.

Thus, it can be seen that there is a need for a storage and display device which is contoured to be installed on existing stadium armrests and which retains advertising and informational materials in a manner which permits stadium patrons to remove and inspect the materials at their leisure.

Moreover, there exists a need for such a device which may be attached to standard, existing stadium armrests, and which may further incorporate an integral beverage cup-holder.

Likewise, a need exists for a device which may be easily and economically manufactured and retrofitted onto existing armrests, which will not interfere with the comfort of stadium patrons utilizing the armrests, nor interfere with pedestrian traffic between the rows of stadium seats.

It is to the provision of a device which meets these needs that the present invention is primarily directed.

BRIEF SUMMARY OF THE INVENTION

Accordingly, it is an object of the present invention to provide a device for displaying and retaining advertising and informational material, which is simple in construction, durable in use, and economical in manufacture.

It is a further object of the present invention to provide such a device which may be quickly and economically retrofitted to existing stadium armrests.

Yet another object of the present invention is to provide a single device which may be mounted to an existing stadium armrest, which will store and display informational and advertising materials, and which incorporates a beverage cup-holder.

Another object of the present invention is to provide such a device which may be easily utilized by stadium patrons, easily cleaned and repaired by maintenance personnel, and which creates minimal intrusion into the seating areas and walkway aisles of the stadium.

A further object of the present invention is to provide a device which is safe and comfortable in use, and pleasing in appearance.

Briefly described, in a preferred form the present invention comprises a bracket adapted to be mounted on an existing stadium or theatre armrest. The upper surface of this bracket includes a resilient clip or flap which may be raised to receive printed advertising and informational materials, such as pamphlets, fliers, brochures, coupons, etc. After inserting the advertising materials, the clip or flap is released, and its resilience acts to retain the advertising or informational materials in place until removed therefrom by the stadium patrons.

The bracket may be designed to fit in close registration with a particular armrest configuration, or alternatively may be designed to accommodate a variety of standard armrests, thereby maximizing efficiency of production.

In one embodiment of the device, the bracket may further include a beverage cup-holder of a size and shape which will accommodate refreshment containers typically provided by stadium concessionaires.

These and other objects, advantages, and features of the present invention will become apparent to those skilled in the art upon reading the following specification in conjunction with the accompanying drawing figures.

BRIEF DESCRIPTION OF THE DRAWING FIGURES

DETAILED DESCRIPTION OF THE PREFERRED EMBODIMENT

Figure 1:
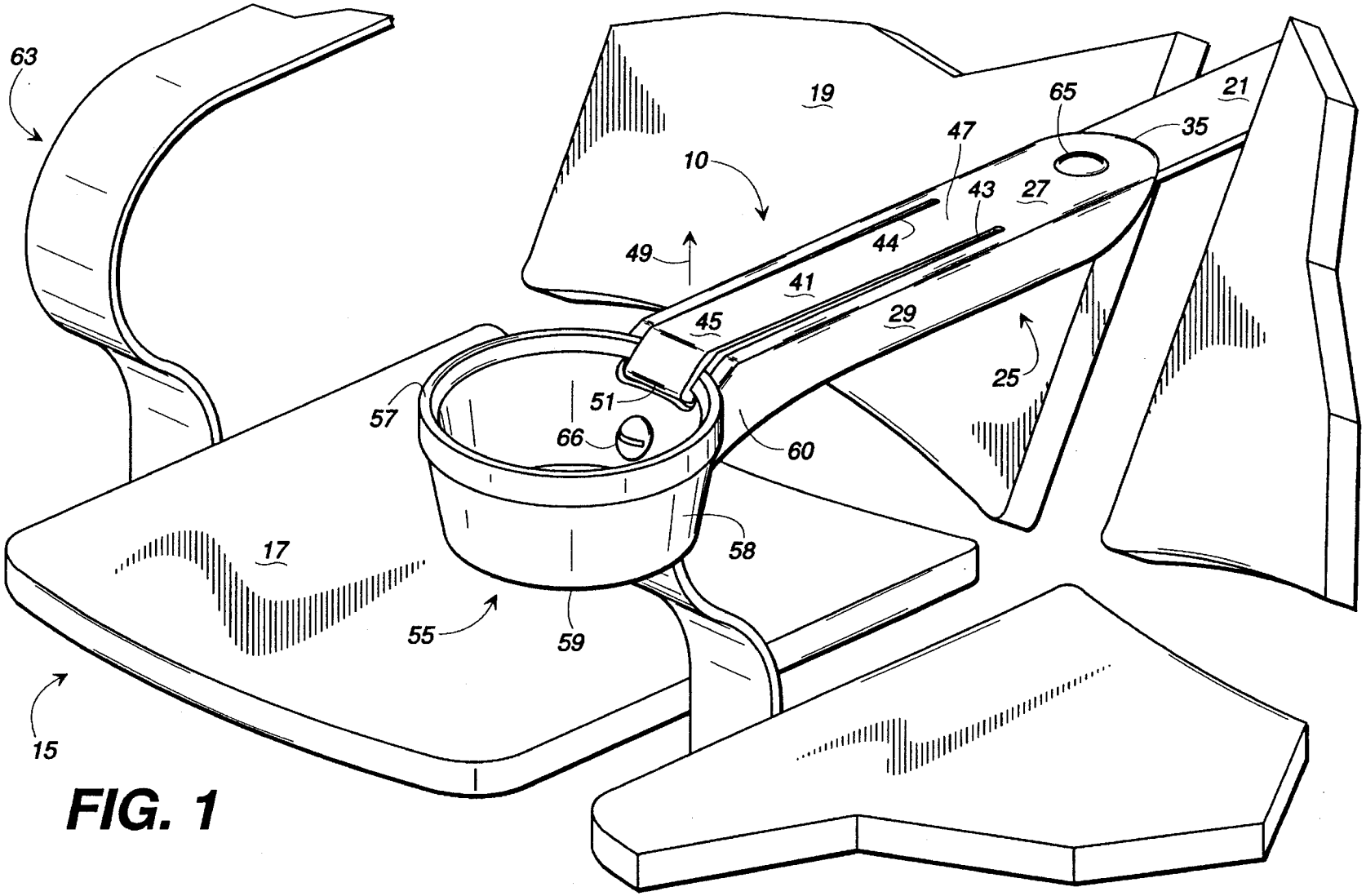
FIG. 1 is a perspective view of a preferred form of the armrest device of the present invention, shown attached to a standard stadium seat armrest, and including a cup-holder.

Referring now in detail to the drawing figures, wherein like reference numerals represent like parts throughout the several views, FIG. 1 depicts an armrest device 10 according to a preferred form of the invention. The armrest device 10 is shown mounted to a stadium seat 15 of typical design having a seat bottom 17, a seat back 19, legs or supports (unshown), and armrests 21. A variety of such stadium seats are commercially available, and are generally of a similar design. Although some existing designs of stadium seats incorporate a cup-holder attached to the seat in a variety of manners, a substantial number of existing stadium seats make no such provision. Armrest device 10 is, likewise, suitable for installation onto other types of seats (e.g. theatre and playhouse seats, portable or folding chairs, director's chairs, etc.) having armrest components.

Figure 2C:
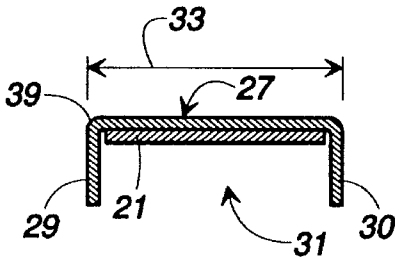
FIG. 2C is a cross-sectional view of the armrest device shown in FIG. 2A.
Figure 2B:
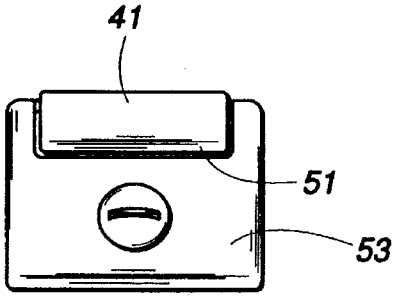
FIG. 2B is a front of the embodiment shown in FIG. 2A.
Figure 2A:
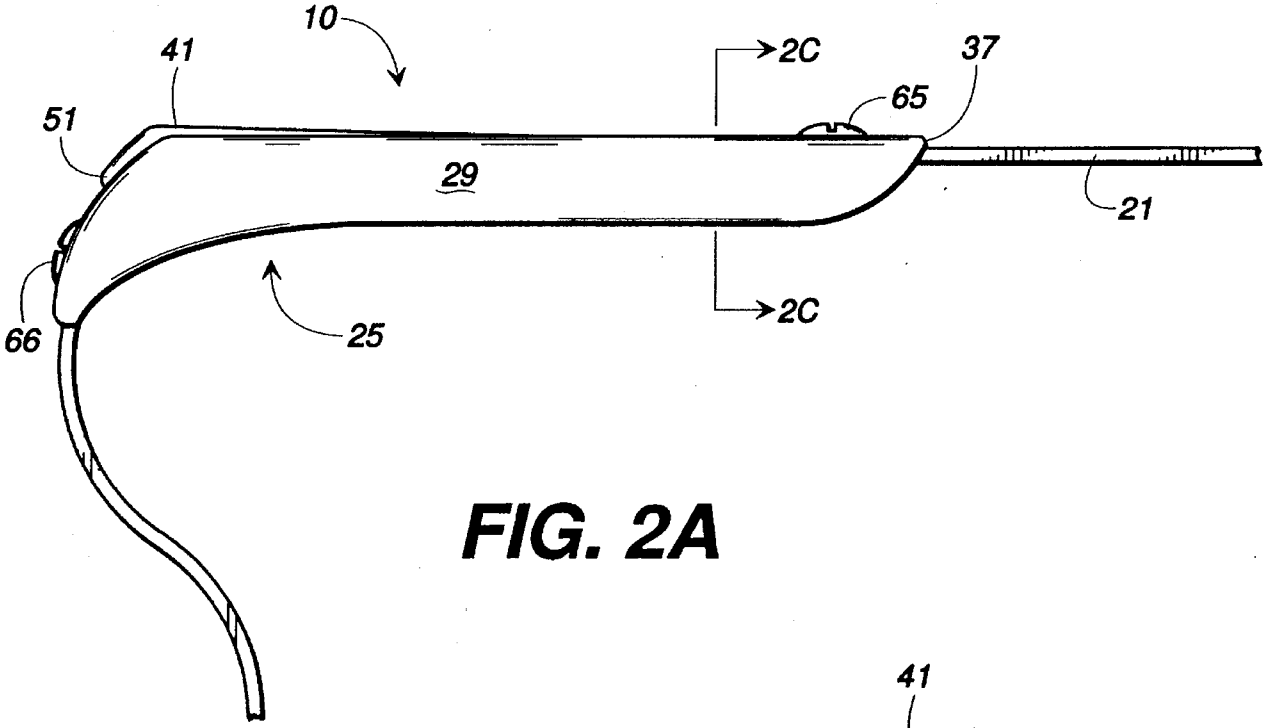
FIG. 2A is a side elevation of another embodiment of the armrest device of the present invention not including a cup-holder.

Armrest device 10 comprises a bracket 25 adapted to engage armrest 21. As shown by FIGS. 1 and 2C, bracket 25 preferably comprises an elongate channel of C-shaped cross section, having a top surface 27 and two side panels 29, 30. Bracket 25 is preferably fabricated having dimensions and contours closely matching those of armrest 21, such that when installed, underside 31 of the bracket 25 fits in close registration with the armrest 21. Bracket 25 is of a width 33 which permits armrest 21 to fit within the channel which forms the underside 31 of the bracket 25, such that side panels 29, 30 extend downward over the side edges of armrest 21. Top surface 27 is a generally rectangular, planar surface which is adapted to provide a comfortable surface upon which stadium patrons may rest their arms when seated. Toward this end, bracket 25 may include beveled edges 37, radius 35, and/or rounds 39 to provide comfort and eliminate snagging or pulling of the patron's clothing. Additionally, top surface 27 may be padded for increase comfort.

Armrest device 10 further comprises a flap 41 for retaining unshown advertisement or informational materials which may be inserted thereunder. Flap 41 is preferably formed by providing two lengthwise slots 43, 44 in the top surface 27 of armrest device 10. Hap 41 has a free end 45 and a connected end 47 as shown by FIG. 1. Alternatively, the orientation of flap 41 may be reversed from that shown by FIG. 1, so that the connected end is arranged toward the forward end of armrest 21 and the free end is toward seatback 19. Slots 43, 44 extend from free end 45 to connected end 47 to form the flap 41. Free end 45 may be drawn upward, away from top surface 27 in the direction indicated by arrow 49. A tab 51 is preferably provided along the edge of free end 45 to facilitate raising flap 41. Bracket 25 is preferably fabricated with flap 41 as an integral part thereof; however, flap 41 may be fabricated as a separate component and thereafter attached to bracket 25 by adhesives, rivets, or other attachment means. Hap 41 is fabricated from a material having sufficient resilience to permit flap 41 to flex at connected end 47, so that advertising or informational materials may be inserted beneath flap 41. The resilience of flap 41 acts to cause flap 41 to spring downward when released, to retain the materials in place.

In one embodiment of the present invention, armrest device 10 further comprises a cup-holder 55 as shown by FIG. 1. In the preferred form of this embodiment, cup-holder 55 is connected to the forward end of bracket 25, so that cup-holder 55 extends beyond the armrest 21 in a cantilevered fashion. Side panels 29, 30 may be flared at their forward ends 60, 61 (61 unshown) to provide additional support for the cup-holder 55. In its preferred form, cup-holder 55 is a hollow, generally frustoconical element having its axis oriented vertically and generally perpendicular to top surface 27 of the armrest device 10. Cup-holder 55 has a circular upper rim 57 of a diameter sufficient to accommodate refreshment containers typically sold by stadium concessionaires. Upper rim 57 is oriented in a generally horizontal position, having its uppermost surface arranged approximately co-planarly with top surface 27 of the armrest device 10. Cup-holder 55 preferably further comprises a circular bottom 59 having a diameter less than that of upper rim 57. Bottom 59 may be provided with drainage holes or slots (unshown) to prevent the accumulation of rain water, spilled drinks, condensate, or other materials within cup-holder 55.

Armrest device 10 is preferably fabricated as a single piece, with the bracket 25, the flap 41, and the cup-holder 55 forming integral parts thereof. Alternatively, the components may be fabricated separately and assembled. Armrest device 10 is preferably fabricated, as by molding, from ABS Plastic, or other weather-resistant material of sufficient structural strength. It is important, however, that the material selected be sufficiently resilient to enable flap 41 to flex upward to receive materials and spring back into place to retain the materials until they are removed. Armrest device 10 may be fabricated in a variety of colors, as to match the color of existing seats, or to contrast in an aesthetically appearing manner, or to match the home team's uniform colors.

Armrest device 10 is attached to an existing stadium seat by placing the armrest device 10, with its top surface 27 facing upward, over the existing armrest 21 of the stadium seat. Any existing padding or other attachments previously installed on the armrest 21 may be removed prior to installation if necessary. Side panels 29, 30 should extend downward, over the side edges of the armrest 21. If the armrest device 10 includes a cup-holder 55, the outer circumferential surface of side wall 58 may be placed in juxtaposition with comer 63 of the armrest 21 to ensure proper and consistent positioning of the armrest device 10 on the armrest 21. If the armrest device 10 does not include a cup-holder, tab 51 or front surface 53 may serve as a positioning means. Armrest device 10 may be attached to armrest 21 by means of screws 65, 66, rivets, adhesives, resilient clips, or other standard attachment means. Alternatively, side walls 29, 30 may be fabricated to snap over, and securely engage armrest 21. Any exposed portions of the fasteners, such as the heads of screws 65, 66 should be rounded or recessed to prevent snagging of patron's clothing. Additionally, vandal-proof attachment means may be desired.

Once installed, the armrest device 10 is utilized by inserting printed advertising and informational material beneath flap 41. Additional advertising space may be provided on exposed surfaces of the armrest device 10, such as the top surface 27 and the side wall 58, to which decals, stickers, or other advertising displays may be applied. The resilience of flap 41 permits it to be raised upward by lifting tab 51 in the direction indicated by direction arrow 49 so that materials may be inserted beneath flap 41. Tab 51 is then released, allowing flap 41 to spring resiliently back into place, thereby securely retaining the inserted materials. If desired, the materials may be placed within a weather-proof wrapper or container, such as a transparent plastic bag, to prevent damage by the elements. The above steps are preferably performed before the patrons arrive at the theatre or stadium; however, it may be desired to replenish the materials, or insert new materials, periodically, such as at the half-time of a sporting event, or during the intermission of a play or musical. Once the patrons arrive at the venue and are seated, the advertising and informational materials may be removed from beneath flap 41 simply and easily, by raising tab 51. In this manner, the patrons may review the materials in detail, at their leisure, and if desired may take the materials with them when they leave.

While the invention has been disclosed in its preferred form, it will be apparent to those skilled in the art that many modifications, additions, and deletions can be made therein without departing from the spirit and scope of the invention and its equivalents as set forth in the following claims.

What is claimed is:

1. In a seat for the seating of a person, the seat having at least one armrest, the armrest having a top armrest surface, a bottom armrest surface and two side armrest surfaces, the improvement comprising:

a. a bracket having a bottom bracket surface and a top bracket surface;

b. attachment means for attaching said bracket to the armrest with said bottom bracket surface being in juxtaposition with the top armrest surface;

c. a resilient flap formed between two substantially parallel slots in said top bracket surface, and having a first end connected to said bracket and a free end distal said first end, said resilient flap being capable of holding flat material in position on said bracket but having sufficient flexibility to permit easy release of the material to the person; and d. a tab for facilitating lifting said flap to release the flat material, said tab formed at said free end of said flap by an interconnection of said slots.

2. The improvement of claim 1, further comprising a cupholder connected to said bracket.

3. The improvement of claim 1, wherein said bracket is constructed of a resilient plastic material.

4. A bracket for retaining and displaying flat informational literature and advertising material on a seat armrest, having a top armrest surface, a bottom armrest surface and two side armrest surfaces, said bracket comprising:

a. a bottom bracket surface;

b. a top bracket surface;

c. attachment means for attaching said bottom bracket surface in juxtaposition with the top armrest surface;

d. a resilient flap for releasably holding the flat informational literature and advertising material in position on said bracket, said resilient flap being formed between two substantially parallel slots in said top bracket surface and having a first end connected to said bracket and a second free end opposite said first end; and e. a tab for facilitating lifting said flap to release the informational literature and advertising material, said tab formed at said second free end of said flap by an interconnection of said slots.

5. The bracket of claim 4 further comprising a cupholder portion.

6. The bracket of claim 4 wherein said bracket is constructed of a resilient plastic material.

* * * * *